US006394449B1

(12) United States Patent
Reist

(10) Patent No.: US 6,394,449 B1
(45) Date of Patent: May 28, 2002

(54) DEVICE FOR RECEIVING AND/OR CONVEYING FLAT PRODUCTS

(75) Inventor: Walter Reist, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/555,316

(22) PCT Filed: Dec. 9, 1998

(86) PCT No.: PCT/CH98/00528

§ 371 (c)(1),
(2), (4) Date: May 22, 2000

(87) PCT Pub. No.: WO99/33734

PCT Pub. Date: Jul. 8, 1999

(30) Foreign Application Priority Data

Dec. 23, 1997 (CH) ..... 2967/97

(51) Int. Cl.[7] ..... B65H 29/04
(52) U.S. Cl. ..... 271/204; 271/82; 198/803.9
(58) Field of Search ..... 271/277, 82, 204, 271/205, 206; 198/803.9

(56) References Cited

U.S. PATENT DOCUMENTS

| | | | | |
|---|---|---|---|---|
| 3,032,341 A | | 5/1962 | Reist | 271/79 |
| 3,122,362 A | * | 2/1964 | Vollrath et al. | 271/204 |
| 4,895,360 A | | 1/1990 | Reist | 271/202 |
| 5,169,139 A | * | 12/1992 | Stauber et al. | 271/204 |
| 5,356,128 A | * | 10/1994 | Eberle et al. | 271/204 |
| 5,380,008 A | * | 1/1995 | Ohno | 271/204 |
| 5,443,360 A | | 8/1995 | Ertavi et al. | 271/277 |
| 5,755,436 A | * | 5/1998 | Reist | 271/204 |
| 5,819,663 A | * | 10/1998 | Klaas et al. | 271/204 |
| 5,931,459 A | * | 8/1999 | Landgren | 271/204 |
| 6,237,744 B1 | * | 5/2001 | Reist | 271/204 |

OTHER PUBLICATIONS

International Search Report for PCT/CH98/00528, Mar. 23, 1999.

* cited by examiner

*Primary Examiner*—H. Grant Skaggs
(74) *Attorney, Agent, or Firm*—Brinks Hofer Gilson & Lione

(57) ABSTRACT

The invention relates to a device for receiving and/or conveying flat products (14), especially printing products, by means of individual grippers (1). The invention comprises a receiving and/or conveying section (12) along which the grippers (1) can be conveyed, and the limbs (9) support opened grippers (1) against one another in the area of the grippers, said grippers being arranged in succession. The invention also comprises a gripper closing device (15) which can be actuated after inserting a product (14) into an opened gripper (1), and/or a releasing device which can be actuated when a product (14) is released from the gripper (1). The receiving and/or conveying section (12) is curved in a convex manner in order to enlarge the maximum possible opening of the gripper.

27 Claims, 4 Drawing Sheets

DEVICE FOR RECEIVING AND/OR CONVEYING FLAT PRODUCTS

Figure 1:
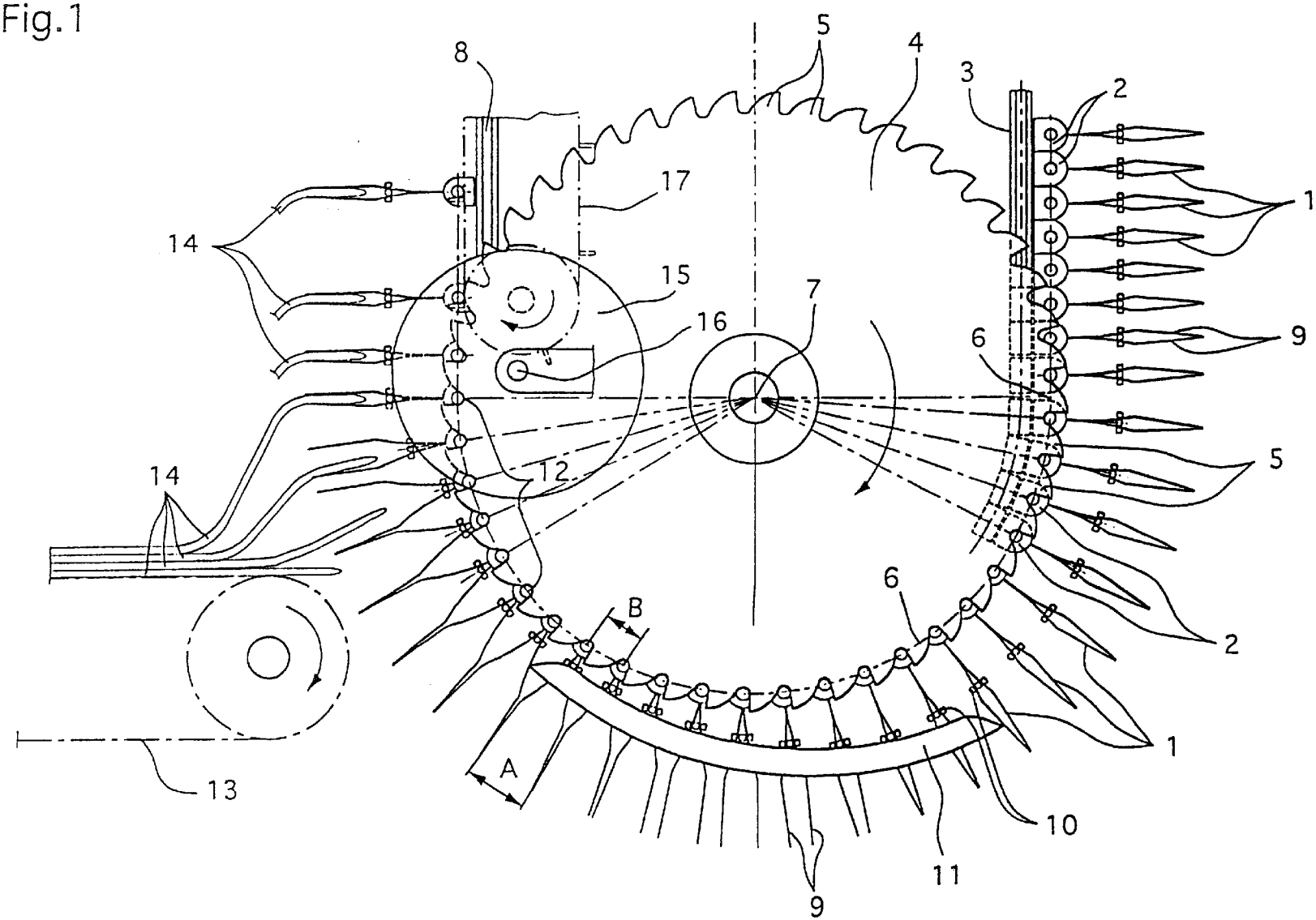

The invention relates to an apparatus according to the preamble of Patent claim 1.

Such apparatuses, as are known, for example, from Swiss Patent CH 382768, are used in order for printed products which are supplied in imbricated formation, for example, by means of a conveying belt to be individually received and transported to further processing stations.

When the printed products are received and discharged by individual grippers, it has to be ensured that the grippers are opened widely enough.

The disadvantage of the apparatus known from CH 382768 is the fact that, on account of the legs of successive grippers being supported against one another, it is only possible to achieve a restricted gripper opening in the region of the receiving or discharging path.

An object of the invention is to develop an apparatus of the type mentioned in the introduction such that it is possible to increase the opening of the grippers in the region of the receiving and/or discharging path.

This object is achieved according to the invention in that the receiving and/or discharging path is curved convexly.

In the region of the receiving and/or discharging path, the gripper opening thus extends in the outward direction, in particular in the radially outward direction, on the side which is located opposite the respective curvature center point, with the result that the arcuate distance located between two open legs of a gripper is greater than the arcuate distance between the centers of two grippers which can be conveyed along the receiving path. This relative sizing is brought about in that the arcuate distance located between the centers of successive grippers is closer to the respective curvature center point than the arcuate distance enclosed by two open legs of a gripper.

The invention thus achieves the situation where, in the region of the receiving and/or discharging path, the grippers can fan out or open further than, for example, in the case of-a rectilinear or concave path.

This advantageously means, for example in the case of grippers which follow closely one after the other, and in particular are in contact with one another, that there is no increase in the distance between the grippers when the latter are opened and/or there is no need to accelerate the grippers since the opening movement of the grippers is obstructed to a lesser extent by adjacent grippers on account of the convex curvature.

The grippers are preferably coupled to transporting means which can be conveyed along the receiving and/or discharging path, it being possible for this coupling to be of both rigid and pivotable design. In the case of grippers which are coupled pivotably to transporting means, the apparatus according to the invention advantageously brings about the situation where on account of the gripper legs being in contact with one another, in the region of the receiving and/or discharging section, the grippers are aligned radially in relation to the respective curvature center point and are thus fixed in a predetermined position, despite the pivotable coupling, during the receiving and/or discharging process. This predetermined alignment of the grippers during the receiving and/or discharging process additionally ensures that precisely positioned movement of the products is possible. In the case of grippers which are coupled pivotably to transporting means, it is preferred if the pivot angle of said grippers is restricted, for example by mechanical stops, in order thus to ensure that force is transmitted satisfactorily to the grippers during the opening movement.

In the region of the receiving and/or discharging path, the transporting means assigned to the grippers are arranged as closely as possible to one another, in order thus to achieve a situation where the individual grippers follow as closely as possible one after the other in this region. In the extreme case, it is possible for successive transporting means to be in contact with one another.

The dimensions of the transporting means in the conveying direction are preferably smaller than the distance between the two legs of an open gripper, with the result that the number of grippers in each path section in the region of the receiving and/or discharging path is restricted essentially by the size of the gripper opening rather than by the size of the transporting means.

The convex receiving and/or discharging path may be designed to be curved in the form of an arc of a circle or in some other way. If the receiving and/or discharging path is designed in the form of an arc of a circle, it is advantageous if, in the region of the receiving and/or discharging path, the grippers are guided by a carry-along wheel, the center point of this carry-along wheel then defining the center point of the curvature of the receiving and/or discharging path according to the invention.

It is advantageous if a gripper-opening device is provided upstream of the receiving path, as seen in the conveying direction, in particular in the region of the carry-along wheel, it being possible for said gripper-opening device to be designed, for example, as an opening guide curved in an arcuate manner.

It is also advantageous if the gripper-closing device, which is necessary for receiving the products, is arranged in the region of the receiving path or directly downstream of the receiving path, as seen in the conveying direction, or at a small distance therefrom. The gripper-closing device may be designed, for example, as a freely rotatable or driven closing wheel which, when the grippers run past the closing wheel, acts on the closing means provided on the grippers so as to initiate a closing movement of the grippers.

Finally, it is preferred if the release device, for releasing products retained by means of the grippers, is arranged in the region of a carry-along wheel and is designed, in particular, as a gripper-opening device. In this case, the gripper-opening device may be designed as an opening guide curved, in particular, in an arcuate manner.

Further preferred embodiments of the invention are specified in the subclaims.

Figure 2:
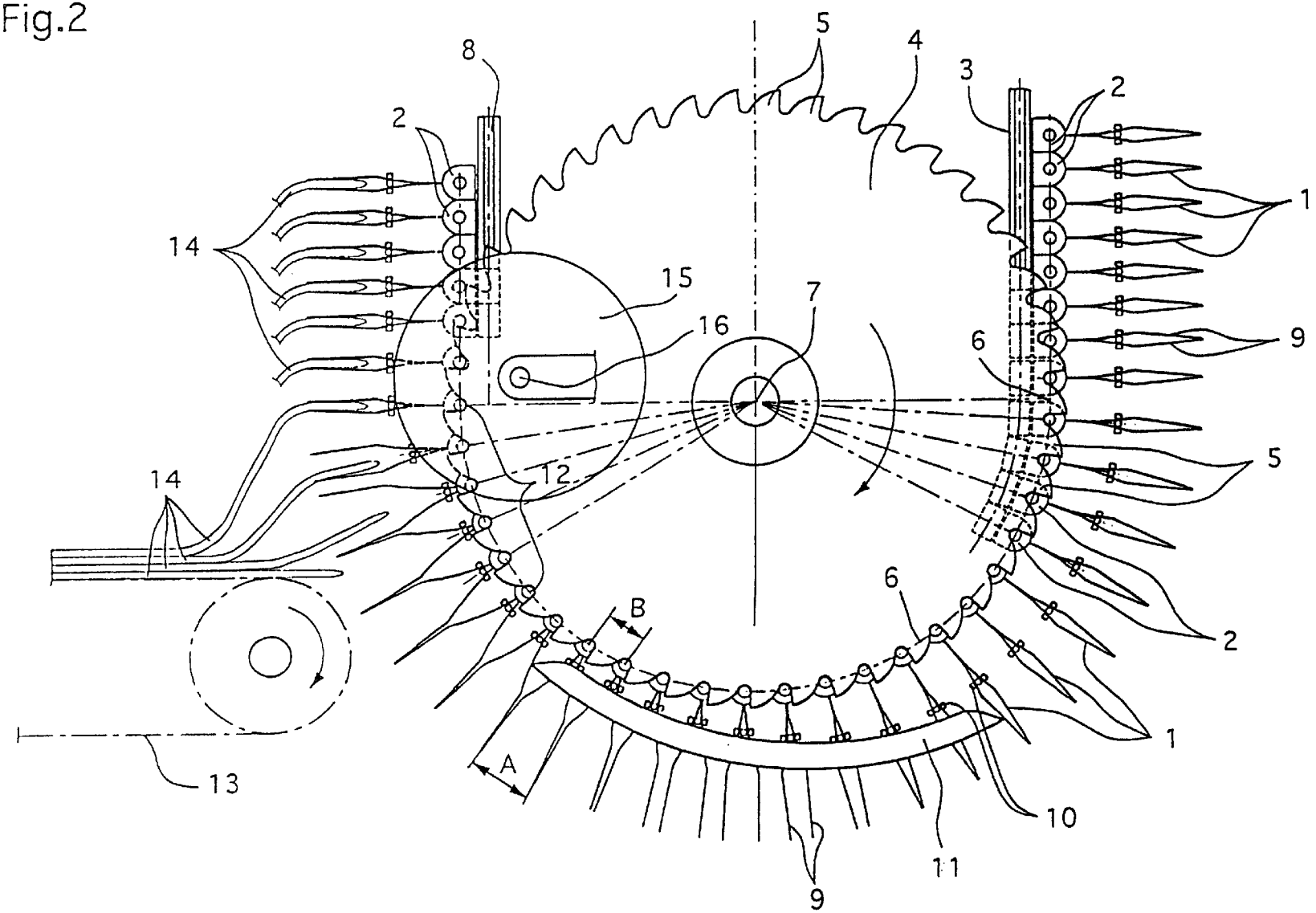
Figure 5:
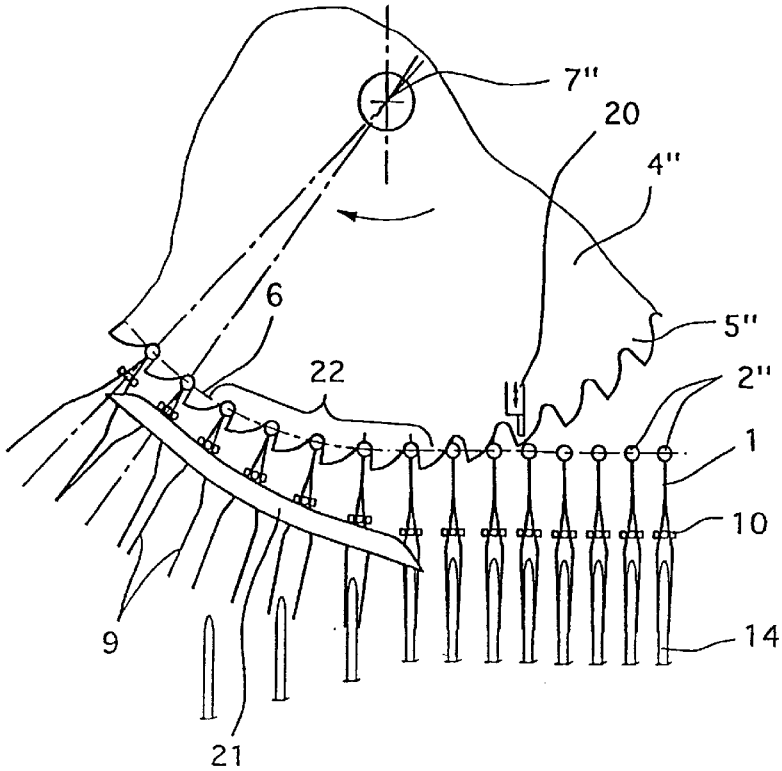
Figure 3:
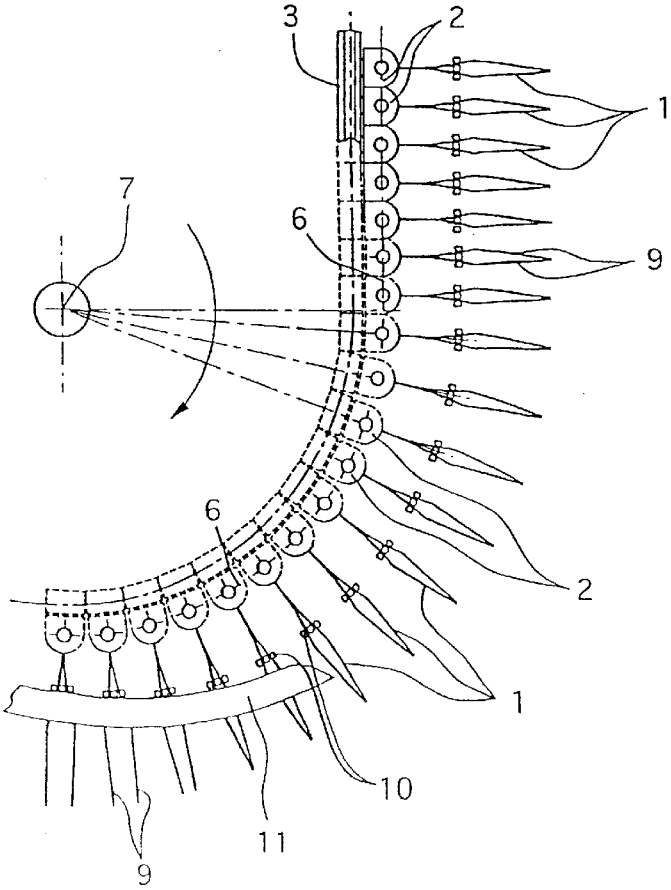
Figure 4:
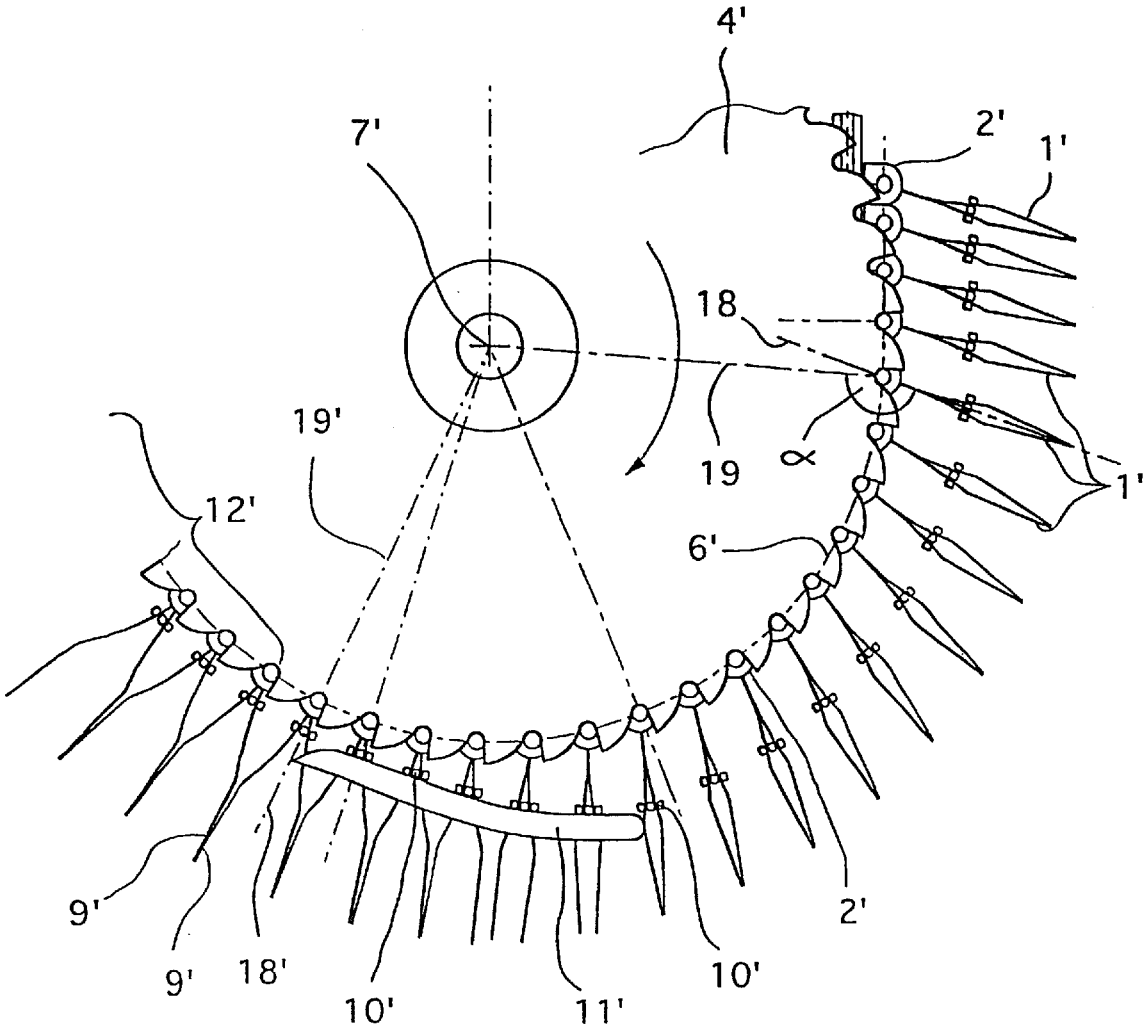

The invention is described hereinbelow, by way of exemplary embodiments, with reference to the drawings, in which:

FIG. 1 shows a first variant of an apparatus according to the invention which is intended for receiving products and has grippers which are coupled rigidly to transporting means, FIG. 2 shows a second variant of an apparatus according to the invention which is intended for receiving products and has grippers which are coupled rigidly to transporting means, FIG. 3 shows a detail of an apparatus corresponding to FIGS. 1 and 2 without a carry-along wheel, FIG. 4 shows an apparatus according to the invention which is intended for receiving products and has grippers which are coupled pivotably to transporting means, and FIG. 5 shows an apparatus according to the invention which is intended for discharging products and has grippers which are coupled rigidly to transporting means.

FIG. 1 shows an exemplary embodiment of an apparatus according to the invention which has a multiplicity of grippers 1 which are each assigned to a transporting means 2 and are coupled rigidly to the same. The transporting means 2 are guided along a vertically running rail 3 such that they can be conveyed into the region of a carry-along wheel 4, which circulates in the clockwise direction.

The carry-along wheel 4 is provided with teeth 5 on its outer circumference, the interspace which is located between two teeth 5 being suitable in each case for receiving a transporting means 2. The teeth 5 are each of saw-tooth form, the steep flank of the saw-tooth form leading, and the shallow flank correspondingly trailing, in the direction of rotation of the carry-along wheel 4.

The transporting means 2, which can be conveyed into the region of the carry-along wheel 4 by the rail 3, can be moved, by the carry-along wheel 4, along a conveying path 6 which describes a semicircle about the point of rotation 7 of the carry-along wheel 4.

Arranged in the end region of the semicircular conveying path 6, on the side located opposite the rail 3, is a further rail 8, along which the transporting means 2 can be conveyed away in the vertically upward direction following passage through the conveying path 6.

The grippers 1 essentially comprise in each case 2 gripper legs 9, which are coupled to the respectively associated transporting means 2 such that they can be moved relative to one another along a circumference line, about the point of rotation 7 of the carry-along wheel 4. This capacity for movement allows the gripper legs 9 to execute opening and closing movements.

Each gripper is assigned an actuating element 10, and the gripper legs 9 can be opened and closed by the radial displacement, in relation to the point of rotation 7, of said actuating element. Displacement of the actuating element 10 in the direction of the point of rotation 7 opens the legs 9 of the gripper 1, and a movement in the opposite direction closes the gripper legs 9.

Provided beneath the carry-along wheel 4 is an opening guide 11 which is curved in an arcuate manner and by means of which the actuating elements 10 of the grippers 1 running past the opening guide 11 in the clockwise direction are displaced in the direction of the point of rotation 7 of the carry-along wheel 4, with the result that, ultimately, all the grippers 1 running past the opening guide 11 are opened as they pass out of the region of the opening guide 11. For this purpose, the opening guide 11 is arranged such that its distance from the point of rotation 7 becomes increasingly smaller in the clockwise direction.

In the direction of rotation of the carry-along wheel 4, the end of the opening guide 11 is adjoined by a receiving path 12, and terminating in the region of the latter is a conveying belt 13 which conveys sheet-like printed products 14 in imbricated formation approximately horizontally onto the receiving path 12, i.e. toward the grippers 1 located in said receiving path 12.

Provided in the end region of the receiving path 12 is a driven or freely rotatable closing wheel 15, of which the point of rotation 16 is arranged in a stationary manner in relation to the point of rotation 7 of the carry-along wheel 4. The position of the closing wheel 15 is selected here such that, in the region of the receiving path 12, the actuating elements 10 of the grippers 1 come into abutment against the outer circumference of the closing wheel 15 and are moved in the radially outward direction, in relation to the point of rotation 7 of the carry-along wheel 4, by said closing wheel, which results in a closing movement of the respective grippers 1. The closing wheel 15 may be designed as a double wheel with two wheels which are of the same size, are spaced apart from one another in the direction perpendicular to the plane of the drawing and can both be rotated about the point of rotation 16 in order thus to achieve the situation where the actuating elements 10 can act in each case on both sides of the gripper legs 9, which results in more uniform force distribution.

As far as the opening guide 11 is concerned, it should be noted here that, as an alternative, it may also extend up to a point just upstream of the closing wheel 15, in order thus for the actuating elements 10 to be fixed as long as possible in their opening position. The opening guide 11 only has to terminate in the region in which the closing wheel 15 causes the actuating elements 10 to move in the radially outward direction.

Provided downstream of the closing wheel 15, as seen in the conveying direction, is a circulating accelerating conveyor 17 by means of which the grippers 1 closed by the closing wheel 15 can be conveyed away as in the vertically upward direction along the rail 8 at elevated speed and large intervals.

During operation of the apparatus illustrated in FIG. 1, the transporting means 2 are conveyed vertically downward along the rail 3 in the direction of the carry-along wheel 4, it being possible here for the conveying operation to take place both actively by way of suitable drive means and passively by means of gravitational force. In the region of the rail 3, the transporting means 2 are so close together that they are in contact with one another. The extent of the conveying means 2 in the conveying direction is slightly greater than the extent of the closed grippers 1 in the conveying direction. It has already been mentioned in this context, however, that the extent of the open grippers 1 in the conveying direction in the region of the receiving path 12 is greater than the extent of the transporting means 2 in the conveying direction.

In each case one transporting means 2 is received between successive interspaces between the teeth 5 and is conveyed along the semicircular conveying path 6 in the direction of the receiving path 12 by means of the carry-along wheel 4. During this conveying process, the grippers 1 extend radially away from the point of rotation 7 of the carry-along wheel 4.

As the grippers 1 run past the opening guide 11, the actuating elements 10 are displaced toward the point of rotation 7, which brings about an opening movement of the gripper legs 9. The actuating elements 10 are preferably displaced in the direction of the point of rotation 7 to such an extent that the gripper legs open to such a pronounced extent that legs 9 of adjacent grippers 1 butt against one another under stressing.

On account of the receiving path 12, which is curved in the form of an arc of a circle, the gripper opening A is greater than the distance B between the centers of two successive transporting means 2. In the case of a receiving path being of a linear design known from the prior art, the maximum gripper opening B which could be achieved would merely correspond to the distance between the centers of successive transporting means 2. However, the gripper opening A can be increased by the curved receiving path 12 according to the invention.

In the region of the receiving path 12, the products 14, delivered in imbricated formation, are conveyed in the direction of the carry-along wheel 4 such that in- each case one product 14 passes into an open gripper 1.

Once products 14 have been introduced into the grippers 1, the grippers 1 pass, by way of their actuating elements 10, into the region of the closing wheel 15, which displaces the actuating elements 10 in the radially outward direction in relation to the point of rotation 7, as a result of which the grippers 1 with the products located therein are closed.

Once the grippers 1 have been closed, in each case one product 14 is retained in a gripper 1, and the unit comprising gripper 1, product 14 and transporting means 2 can be conveyed away in the vertically upward direction along the rail 8, at elevated speed and larger intervals, by means of the accelerating conveyor 17.

The rigid coupling of the grippers 1 to the transporting means 2 according to FIG. 1 ensures that the longitudinal extent of the grippers 1 is always oriented perpendicularly to the transporting or conveying direction thereof.

FIG. 2 shows a second variant of an apparatus according to the invention, this variant essentially corresponding to the variant according. to FIG. 1 and only differing therefrom in that there is no accelerating conveyor 17 provided in the region following the receiving path 12. According to FIG. 2, the closed grippers 1, each retaining a product 14, are thus conveyed away from the carry-along wheel 4 such that successive transporting means 2 are in contact with one another. This means that the distance between successive grippers 1 is the same in each case upstream and downstream of the carry-along wheel 4, as seen in the conveying direction, since the transporting means 2, which are assigned to the grippers 1, of successive grippers 1 are in contact with one another both upstream and downstream of the carry-along wheel 4.

This makes it possible to achieve, according to the invention, the situation where the increased gripper opening achieved on account of the convex curvature of the receiving path 12 allows products 14 to be received without the grippers 1 having to be accelerated and without the distance between the grippers 1 having to be increased.

FIG. 3 shows a detail of an apparatus corresponding to FIGS. 1 and 2, this detail involving a region in which the grippers 1 run into a curved path and are open. The difference from the apparatuses according to FIGS. 1 and 2 is that there is no carryalong wheel provided according to FIG. 3.

The transporting means 2 are thus merely guided in the rail 3 in the region of the convex curvature, the successive transporting means 2 being in contact with one another. In this case, the transporting means 2 may be driven in different ways. For example, it is possible for the transporting means 2 to be moved in the conveying direction by gravitational force or by separate drive means (not illustrated). It is likewise possible for the conveying means to push one another in the conveying direction, a suitable drive means only ever acting in each case on one or more downstream conveying means, as seen in the conveying direction.

FIG. 4 shows an apparatus essentially corresponding to the apparatuses according to FIGS. 1 and 2, the essential difference from FIGS. 1 and 2 being that the grippers 1' are coupled pivotably to the transporting means 2'.

In addition, the opening guide 11' is of somewhat shorter design than that according to FIGS. 1 and 2, although its curvature has been selected such that it is nevertheless possible to ensure that the grippers 1 [sic] are open to the full extent by the actuating elements 10' being displaced in the direction of the point of rotation 7' of the carry-along wheel 4'.

On account of the pivoting capacity of the grippers 1' and transporting means 2' relative to one another, the grippers 1' pivot downward as far as possible until their pivoting movement is braked, for example, by a stop (not illustrated). On account of this pivoting movement, the angle a [sic] between the gripper longitudinal axis 18 and the radius 19 intersecting the gripper longitudinal axis 18 in the region of the conveying path 6' is less than 180°, provided the grippers 1' are closed.

By virtue of the grippers 1' being opened, by means of the opening guide 11', the legs 9' of adjacent grippers 1' are supported against one another and thus cause the grippers 1' to be aligned radially in relation to the point of rotation 7'. In this case, the angle between the gripper longitudinal axis 18' and the radius 19' is 180°, i.e. the gripper longitudinal axis 18' and radius 19' coincide. In an alternative embodiment of the invention, it is also possible for said angle to be more than 180°.

In the same way as in FIGS. 1 and 2, it is possible for a receiving path 12' to follow the region which adjoins the opening guide 11' in the direction of rotation of the carry-along wheel 4'.

The open grippers 1' are fixed particularly well in the radial direction if the legs 9' of adjacent grippers 1' butt against one another under stressing, i.e. if the actuating elements 10' are displaced in the radially inward direction to such an extent that, were there no adjacent grippers 1' present, the grippers would open even further than is illustrated in FIG. 4.

Although, according to FIG. 4, the grippers 1' are thus connected pivotably to the transporting means 2', the ultimate result downstream of the opening guide 11', as seen in the conveying direction, is the same precise, radially outwardly directed alignment of the open grippers 1' as in the case of an apparatus according to FIGS. 1 and 2, in which the grippers 1 are coupled rigidly to the transporting means 2.

FIG. 5 shows an apparatus according to the invention which is intended for discharging products 14 and has grippers 1 which are coupled rigidly to transporting means 2".

The grippers 1 are conveyed along a rectilinear path toward the apparatus illustrated, and retain in each case one product 14 in the process. In this case, the above mentioned actuating element 10 is located in its closed position.

Provided in the end region of the rectilinear path is a synchronizing arrangement 20 which ensures that in each case one transporting means 2" with associated gripper 1 passes into the interspace between two successive teeth 5" of a carry-along wheel 4".

The carry-along wheel 4", which rotates about the point of rotation 7", conveys the transporting means 2" past a release device 21, the release device 21 being designed as an opening guide curved in an arcuate manner.

In the same way as the opening guide 11 according to FIG. 1, the release device 21 causes the actuating elements 10 to be displaced in the direction of the point of rotation 7", which ultimately results in the legs 9 of the grippers 1 opening.

Since this operation of opening the grippers 1 takes place in the region of a convexly curved discharging path 22, it is ensured that the gripper legs 9 can open sufficiently in order to release a product 14 retained in a gripper 1. This sufficiently wide opening of the grippers 1 can be brought about without the grippers 1 or the transporting means 2" having to be accelerated before or during the opening process.

What is claimed is:

1. Apparatus for receiving sheet-like products, in particular printed products, comprising: a plurality of transporting mechanisms; individual grippers, having legs that can be opened and closed, coupled to corresponding transporting mechanisms; said transporting mechanisms having a receiving path along which the grippers can be conveyed, said receiving path including a region in which the legs of successive, open grippers are supported against one another; each transporting mechanism having a given dimension, measured in the direction of transport, that is less than the distance between the legs of an open gripper such that the number of grippers that can occupy said region of the receiving path is restricted by the size of an open gripper rather than by the size of the transporting mechanisms; a gripper-closing device, which can be actuated once a product has been introduced into an open gripper; said receiving path is curved convexly in order to increase the maximum possible gripper opening; and an accelerating conveyor for transporting the transporting mechanisms and corresponding gripper and gripped product away from the region of the receiving path at elevated speeds and with larger intervals between the transporting mechanisms.

2. Apparatus according to claim 1, characterized in that the gripper opening extends in the radially outward direction on that side of the receiving path which is located opposite the respective curvature center point.

3. Apparatus according to claim 1 or 2, characterized in that the grippers are coupled rigidly to the corresponding transporting mechanism.

4. Apparatus according to claim 3, characterized in that the pivot angle is restricted.

5. Apparatus according to claim 3, characterized in that, in the region of the receiving path, successive transporting mechanism are spaced apart from one another.

6. Apparatus according to claim 3, characterized in that, in the region of the receiving path, successive transporting mechanism are in contact with one another.

7. Apparatus according to claim 1 or 2, characterized in that the receiving path is curved in the form of an arc of a circle.

8. Apparatus according to claim 1 or 2, characterized in that, in the region of the receiving path, the grippers are guided by a carry-along wheel.

9. Apparatus according to claim 8, characterized in that a gripper-opening device is provided upstream of the receiving path, in the region of the carry-along wheel.

10. Apparatus according to claim 1 or 2, characterized in that a gripper-opening device is provided upstream of the receiving path, as seen in the conveying direction.

11. Apparatus according to claim 10, characterized in that the gripper-opening device is designed as an opening guide curved, in an arcuate manner.

12. Apparatus according to claim 11, characterized in that the gripper-closing device is arranged in the region of the receiving path, as seen in the conveying direction.

13. Apparatus according to claim 12, characterized in that the gripper-closing device is designed as a freely rotatable closing wheel.

14. Apparatus according to claim 12, characterized in that the gripper-closing device is designed as a driven closing wheel.

15. Apparatus according to claim 11, characterized in that the gripper-closing device is arranged downstream of the receiving path, as seen in the conveying direction.

16. Apparatus according to claim 1 or 2, characterized in that the grippers are pivotally coupled to the corresponding transporting mechanism.

17. Apparatus for discharging sheet-like products, in particular printed products, comprising: a plurality of transporting mechanisms; individual grippers, having legs that can be opened and closed, coupled to corresponding transporting mechanisms; said transporting mechanisms having a discharging path along which the grippers can be conveyed, said discharging path including a region in which the legs of successive, open grippers are supported against one another; each transporting mechanism having a given dimension, measured in the direction of transport, that is less than the distance between the legs of an open gripper such that the number of grippers that can occupy said region of the discharging path is restricted by the size of an open gripper rather than by the size of the transporting mechanisms; a gripper-release device, which can be actuated when it is desired to discharge a product; said discharging path is curved convexly in order to increase the maximum possible gripper opening; and an accelerating conveyor for transporting the transporting mechanisms and corresponding empty gripper away from the region of the discharging path at elevated speeds and with larger intervals between the transporting mechanisms.

18. Apparatus according to claim 17, characterized in that the gripper opening extends in the radially outward direction on that side of the discharging path which is located opposite the respective curvature center point.

19. Apparatus according to claim 17 or 18, characterized in that the grippers are coupled rigidly to the transporting means.

20. Apparatus according to claim 19, characterized in that the pivot angle is restricted.

21. Apparatus according to claim 19, characterized in that, in the region of the discharging path, successive transporting means are spaced apart from one another.

22. Apparatus according to claim 19, characterized in that, in the region of the discharging path, successive transporting mechanism are in contact with one another.

23. Apparatus according to claim 17 or 18, characterized in that the discharging path is curved in the form of an arc of a circle.

24. Apparatus according to claim 17 or 18, characterized in that, in the region of the discharging path, the grippers are guided by a carry-along wheel.

25. Apparatus according to claim 24, characterized in that the release device is arranged in the region of the carry-along wheel and is designed, in particular, as a gripper-opening device.

26. Apparatus according to claim 25, characterized in that the release device is designed as an opening guide curved, in an arcuate manner.

27. Apparatus according to claim 17 or 18, characterized in that the grippers are pivotably coupled to the corresponding transporting mean.

* * * * *

UNITED STATES PATENT AND TRADEMARK OFFICE

CERTIFICATE OF CORRECTION

PATENT NO. : 6,394,449 B1
DATED : May 28, 2002
INVENTOR(S) : Walter Reist

It is certified that error appears in the above-identified patent and that said Letters Patent is hereby corrected as shown below:

Column 8,
Line 1, delete "claim 19," and substitute -- claim 27, -- in its place.
Line 2, immediately after "curved" delete "," (comma).

Signed and Sealed this

Tenth Day of June, 2003

JAMES E. ROGAN
*Director of the United States Patent and Trademark Office*